US008991297B2

(12) United States Patent
Potter et al.

(10) Patent No.: US 8,991,297 B2
(45) Date of Patent: Mar. 31, 2015

(54) COMPRESSORS WITH IMPROVED SEALING ASSEMBLIES

(75) Inventors: Dan Potter, Lancaster, CA (US); Trung Tran, Torrance, CA (US)

(73) Assignee: Honeywell International Inc., Morristown, NJ (US)

( * ) Notice: Subject to any disclaimer, the term of this patent is extended or adjusted under 35 U.S.C. 154(b) by 839 days.

(21) Appl. No.: 13/273,045

(22) Filed: Oct. 13, 2011

(65) Prior Publication Data

US 2013/0092023 A1 Apr. 18, 2013

(51) Int. Cl.

| | |
|---|---|
| ***F01B 31/00*** | (2006.01) |
| ***F16J 10/04*** | (2006.01) |
| ***F04B 25/00*** | (2006.01) |
| ***F04B 39/12*** | (2006.01) |
| ***F04B 53/16*** | (2006.01) |

(52) U.S. Cl.

CPC ..... *F04B 39/125* (2013.01); *F04B 39/126* (2013.01); *F04B 53/166* (2013.01); *F04B 53/168* (2013.01)

USPC ..... 92/86; 92/148; 92/171.1; 417/266

(58) Field of Classification Search

USPC ..... 92/58, 72, 86, 148, 152, 171.1; 277/530, 567, 647; 417/266

See application file for complete search history.

(56) References Cited

U.S. PATENT DOCUMENTS

| | | | |
|---|---|---|---|
| 1,009,819 | A | 11/1911 | Alberger |
| 2,380,606 | A | 7/1945 | Moody |
| 3,680,973 | A | 8/1972 | Pilarczyk |
| 3,869,963 | A | 3/1975 | Schindel |
| 4,197,786 | A | 4/1980 | Pillon |
| 4,463,663 | A | 8/1984 | Hanson, Jr. et al. |
| 5,031,509 | A | 7/1991 | Cowan |
| 5,078,580 | A | 1/1992 | Miller et al. |
| 5,280,924 | A | 1/1994 | Burgess |
| 6,389,955 | B1 | 5/2002 | Schaefer |
| 7,343,848 | B2 | 3/2008 | Maher et al. |
| 7,966,925 | B2 | 6/2011 | Tran et al. |

*Primary Examiner* — Michael Leslie

(74) *Attorney, Agent, or Firm* — Ingrassia Fisher & Lorenz, P.C.

(57) ABSTRACT

A compressor includes a housing; a compressor liner positioned within the housing and at least partially defining a first cylinder with an inlet and an outlet; a piston positioned within the first cylinder and configured to compress air flowing into the first cylinder through the inlet; a cylinder head at least partially defining the first cylinder; and a sealing assembly for sealing an interface between the compressor liner and the cylinder head. The sealing assembly includes a ring seal at an interface between the cylinder head and the compressor liner; a vent port on an opposite side of the ring seal from the first cylinder; and a vent tube extending between the vent port and the inlet such that air leaking through the ring seal from the first cylinder flows through the vent port, through the vent tube, and into the inlet.

20 Claims, 3 Drawing Sheets

COMPRESSORS WITH IMPROVED SEALING ASSEMBLIES

TECHNICAL FIELD

The present invention generally relates to compressors, and more particularly relates to high temperature and high pressure sealing assemblies in compressors.

BACKGROUND

Air recharge systems (ARS) are designed for use in aircraft applications. For example, the ARS may be used, in flight or on the ground, to recharge air bottles of a stored energy system to high pressures, such as 5000 psig and above. As such, a typical ARS uses a compressor with a number of stages to compress air to the desired pressures.

Generally, o-ring type seals are employed in piston or rod sealing applications, such as within compressors, to provide a seal between two adjacent cylindrical surfaces. These seals are subjected to various external forces and conditions throughout such use. At low pressure and low temperature conditions, seals may accommodate non-uniform pressure distribution due to the nature of their resilient, flexible and elastic compositions. Seals subjected to high pressure, for example, greater than about 3000 psig, and high temperatures, for example, greater than about 300° F., tend to deform, and gradually extrude into, for example, the sealed gap between the adjacent cylindrical surfaces. In addition, elevated temperatures eventually may reduce the physical qualities of resilient, flexible, and elastic materials. As such, these types of seals may need to be replaced at an undesirable frequency and/or leakages may occur, thereby reducing the efficiency and service life of the compressors.

Engineers have attempted to design more robust seals by redesigning the shape, increasing or decreasing the diameters and thicknesses, and the like, or by altering the compositions in order to improve the ability to withstand higher temperatures and pressures and to increase the service life of the seal. While these designs have met with some success, improvements to conventional sealing assemblies in applications such as high temperature and high pressure compressors are desired.

Accordingly, it is desirable to provide improved sealing assemblies, particularly sealing assemblies for compressors. Furthermore, other desirable features and characteristics of the present invention will become apparent from the subsequent detailed description of the invention and the appended claims, taken in conjunction with the accompanying drawings and this background of the invention.

BRIEF SUMMARY

In accordance with an exemplary embodiment, a compressor includes a housing; a compressor liner positioned within the housing and at least partially defining a first cylinder with an inlet and an outlet; a piston positioned within the first cylinder and configured to compress air flowing into the first cylinder through the inlet; a cylinder head at least partially defining the first cylinder; and a sealing assembly for sealing an interface between the compressor liner and the cylinder head. The sealing assembly includes a ring seal at an interface between the cylinder head and the compressor liner; a vent port on an opposite side of the ring seal from the first cylinder; and a vent tube extending between the vent port and the inlet such that air leaking through the ring seal from the first cylinder flows through the vent port, through the vent tube, and into the inlet.

In accordance with an exemplary embodiment, a sealing assembly is provided between a first component and a second component of a compressor with a cylinder having an inlet and an outlet. The assembly includes a ring seal between the first component and the second component at the outlet of the compressor; a vent port defined by the first component and at least partially sealed by the ring seal from air compressed within the cylinder; and a vent tube extending between the vent port and the inlet such that any portion of the air that leaks through the ring seal flows through the vent port, through the vent tube, and into the inlet.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Broadly, exemplary embodiments discussed herein provide a sealing assembly for a high pressure compressor, such as a four stage compressor of an aircraft air recharge system. A number of o-rings may be provided between the compressor liner and compressor housing. Additionally, a c-seal is provided in a recess at an interface between the housing, the compressor liner, and the cylindrical head in the fourth stage of the compressor. A vent may be provided to prolong the life of the c-seal and to prevent leaks from flowing into undesirable areas. Additionally, the vent may be fluidly coupled to the inlet of the fourth stage such that any air leaking through the c-seal is vented back into the fourth stage and such that the pressure differential across the c-seal is reduced, thereby improving the efficiency of the compressor and further improving the service life of the c-seal.

Figure 1:
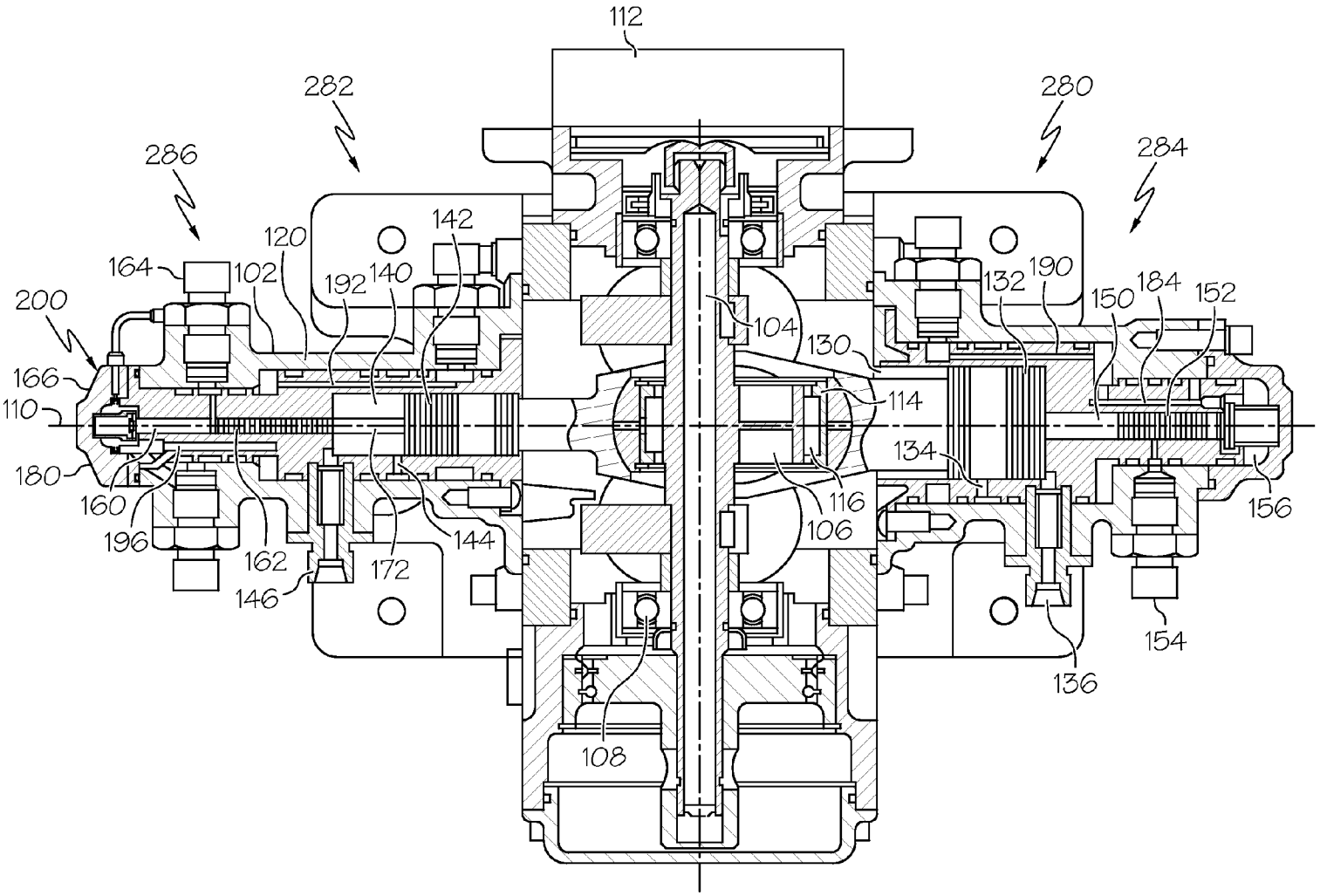
FIG. 1 is a cross-sectional view of a high pressure, high temperature compressor incorporating a sealing assembly in accordance with an exemplary embodiment.

FIG. 1 is a cross-sectional view of a high pressure, high temperature compressor 100 incorporating a sealing assembly 200 in accordance with an exemplary embodiment. In one exemplary embodiment, the compressor 100 may be used in an air recharge system (ARS) designed for use in aircraft applications. For example, the ARS may be used, in flight or on the ground, to recharge air bottles of a stored energy system to about 5000 psig. In one exemplary embodiment, the aircraft and/or a pilot will evaluate the pressure and temperature to determine 100% propellant in the recharge air bottles. As described below, the compressor 100 is a four stage compressor, although the sealing assembly 200 may also be incorporated into a compressor with any number of stages and/or other high pressure applications.

The compressor 100 generally includes a housing 102 that houses a drive shaft 104 and a compressor liner 120. The compressor liner 120 defines four cylinders 130, 140, 150, and 160 that respectively decrease in size to sequentially compress air in stages, as described below. The compressor liner 120 and housing 102 may be formed from any suitable material, such as heat treated stainless steel or iron.

The drive shaft 104 includes an eccentric circular lobe 106 and is supported on ball bearings 108, perpendicular to an axis 110 of the cylinders 130, 140, 150, and 160. The drive shaft 104 may be coupled to and driven by a motor 112 mounted to the housing 102. A piston assembly 170 is mounted on the drive shaft 104 at the eccentric circular lobe 106 via a slider 114 and a needle bearing 116. The piston assembly 170 includes a yoke 172 extending through the cylinders 130, 140, 150, and 160. Pistons 132, 142, 152, and 162 are mounted on the yoke 172 in the cylinders 130, 140, 150, and 160 and are reciprocally driven in a linear motion when the drive shaft 104 is rotated, as discussed below.

More specifically, the first cylinder 130 corresponds to the first stage 280 of the compressor 100. When the first piston 132 is in a withdrawn position (e.g., to the left in the view of FIG. 1), air may enter the first cylinder 130 through an inlet 134. The air is compressed within the compressor liner 120 as the piston 132 moves through the cylinder 130 to the other side of the first cylinder 130 (e.g., the position generally shown in FIG. 1), e.g., the air is compressed between the piston 132 and compression liner 120 as the piston 132 reduces the available volume of the first cylinder 130. The air leaves the first cylinder 130 via an outlet 136, which is fluidly coupled to an inlet 144 of the second stage 282.

The second cylinder 140 corresponds to the second stage 282 of the compressor 100. When the second piston 142 is in a withdrawn position (e.g., the position generally shown in FIG. 1), air may enter the second cylinder 140 through the inlet 144. The air is compressed within the compressor liner 120 as the piston 142 moves through the cylinder 140 (e.g., to the left in FIG. 1), e.g., the air is compressed between the piston 142 and compression liner 120 as the piston 142 reduces the available volume of the second cylinder 140. The air leaves the second cylinder 140 via an outlet 146, which is fluidly coupled to an inlet 154 of the third stage 284.

The third cylinder 150 corresponds to the third stage 284 of the compressor 100. When the third piston 152 is in a withdrawn position (e.g., to the left in the view of FIG. 1), air may enter the third cylinder 150 through the inlet 154. The air is compressed within the compressor liner 120 as the piston 152 moves through the cylinder 150 to the other side of the cylinder 150 (e.g., to the position generally shown in FIG. 1) e.g., the air is compressed between the piston 152 and compression liner 120 as the piston 152 reduces the available volume of the third cylinder 150. The air leaves the third cylinder 150 via an outlet 156, which is fluidly coupled to an inlet 164 of the fourth stage 286.

The fourth cylinder 160 corresponds to the fourth stage 286 of the compressor 100. When the fourth piston 162 is in a withdrawn position (e.g., as is generally shown in FIG. 1), air may enter the fourth cylinder 160 through the inlet 164. The air is compressed within the compressor liner 120 as the piston 162 moves through the fourth cylinder 160 (e.g., to the left in FIG. 1) e.g., the air is compressed between the piston 162 and compression liner 120 as the piston 162 reduces the available volume of the fourth cylinder 160. The air leaves the fourth cylinder 160 via an outlet (not shown) of the compressor 100, which in this embodiment is fluidly coupled to an air bottle of the ARS. The fourth cylinder 160 may be capped by a cylinder head 180. Various check valves may be provided, for example, incorporated into the inlets and outlets for to ensure proper operation of the compressor 100.

As shown in FIG. 1, the cylinders 130, 140, 150, and 160 have decreasing sizes such that the air is compressed to higher and higher pressures as the air works through the stages. Since consecutive stages are paired on opposite sides of the drive shaft 104 and since the pistons 132, 142, 152, and 162 are driven on a common yoke 172, each stage of the compressor 100 compresses a portion of air during a given cycle. In one exemplary embodiment, the air is provided to the first stage 280 at about 30 psig. The first stage 280 compresses the air to about 150 psig. The second stage 282 compresses the air to about 500 psig, and the third stage 284 compresses the air to about 1800 psig. Finally, the fourth stage 286 compresses the air to about 5000 psig. In other embodiments, the pressure from the fourth stage 286 may exceed 5000 psig, including pressures greater than about 6000 psig or about 7000 psig The compressor 100 further includes a number of cooling passages 190, 192, 194, and 196 that remove heat from the air as it is compressed. The cooling fluid may be, for example, liquid polyalphaolefin (PAO). The cooling fluid may circulate at about 200 psig and about 180° F., as an example. Although not discussed in greater detail, the compressor 100 may further include an oil lubrication system, a downstream oil separation and return system, and a water removal and air drying system for conditioning the air as it is compressed.

As described below, the sealing assembly 200 is provided within the compressor 100 to prevent or mitigate air or cooling fluid from leaking within the compressor 100. Particularly, the sealing assembly 200 prevents or mitigates leakage at the interfaces between the compressor liner 120 and the housing 102 and between the compressor liner 120 and the cylinder head 180. Leakage is primarily an issue in the fourth stage, e.g., where the pressures are the highest. The sealing assembly 200 is discussed in greater detail with reference to FIG. 2.

Figure 2:
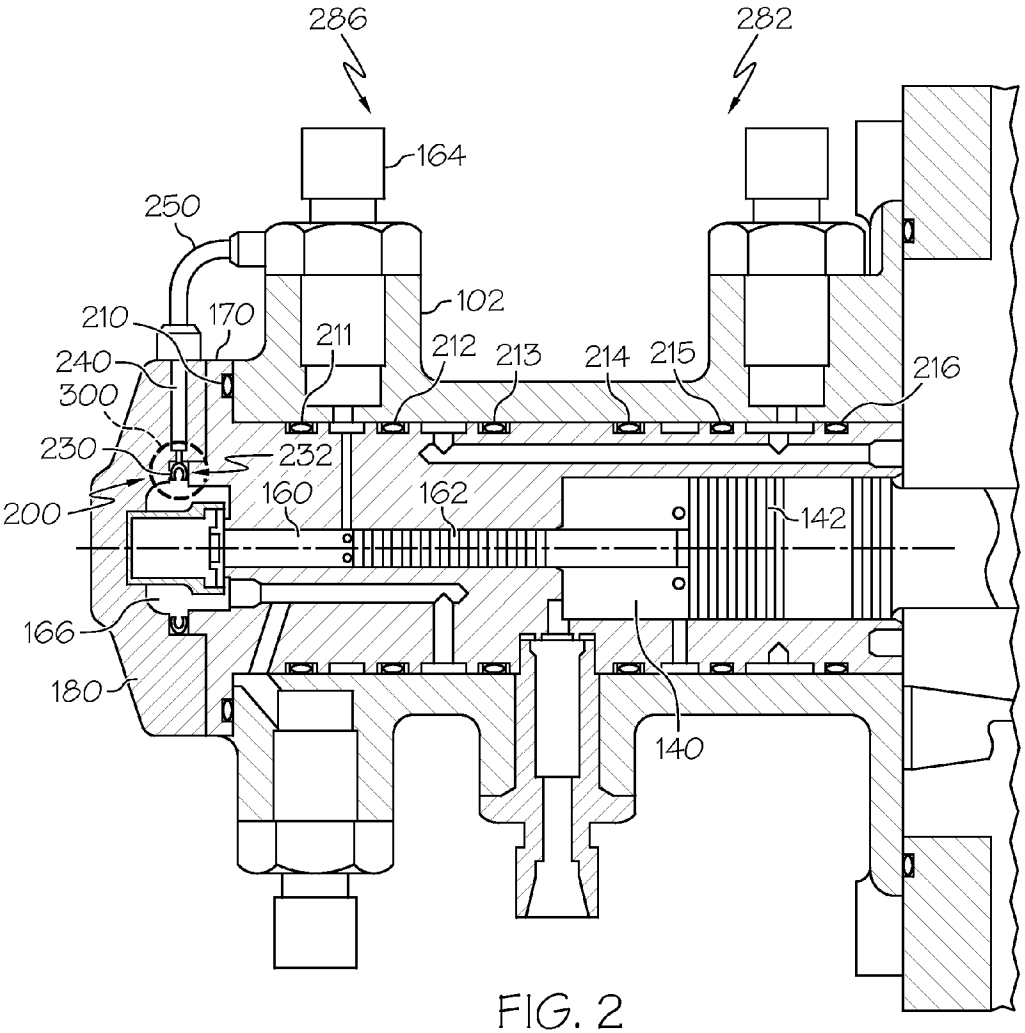
FIG. 2 is a partial cross-sectional view of the sealing assembly of FIG. 1 in accordance with an exemplary embodiment.

FIG. 2 is a partial cross-sectional view of the sealing assembly 200 of the compressor 100 of FIG. 1 in accordance with an exemplary embodiment. FIG. 2 particularly shows the second and fourth stages of the compressor 100. As noted above, the sealing assembly 200 prevents or mitigates air or cooling fluid from leaking during the compression cycle.

As shown in the view of FIG. 2, the sealing assembly 200 includes a number of o-rings 210-216 to seal interfaces between the compressor liner 120 and the housing 102. The o-rings 210-216 may be provided in recesses in the compressor liner 120 and may be supported by one or more back-up rings. In general, the o-rings 211-216 prevent or mitigate leakage between the compressor liner 120 and housing 102, and the o-ring 210 prevents or mitigates leakage between the cylinder head 180 and housing 102.

The o-rings 210-216 may be constructed from flexible, resilient materials or any other material possessing the physical qualities capable to withstand high pressures. For example, o-rings 210-216 may be formed of materials such as synthetic rubber compositions, elastomeric substances, particularly silicone based compositions, fluoropolymer based compositions, fluorosilicone based compositions, other plastics such as polyether etherketone, polyamides, polyimides, polyethersulfone, other hi-modulus plastic compositions, and the like, alone or in combination with one or more reinforcing materials and/or additives, such as plasticizers, thermal stabilizers, antioxidants, light stabilizers, flame retardants, lubricants, foaming agents, blowing agents, surfactants, metal stabilizers, organostabilizers, organometallic stabilizers, and the like. In one embodiment, the o-rings 210-216 may be a graphite reinforced fluoropolymer material, such as graphite reinforced Teflon®.

The sealing assembly 200 further includes a c-seal 230 at the interface between the compressor liner 120, the housing 102, and the cylinder head 180. The c-seal 230 is positioned within a recess 232 defined between the cylinder head 180 and the compressor liner 120. As shown in FIG. 2 and in greater detail in FIG. 3, the c-seal 230 has a c-shaped cross-sectional shape that is formed as an annular ring. In one exemplary embodiment, the c-seal 230 is an internal pressure c-seal, and the recess 232 is a counter-bore recess. In other embodiments, other types of ring seals and recesses may be provided. The c-seal 230 may be resilient such that each side of the c-seal 230 is biased outward to fill the recess 232. In general, the c-seal 230 may be any suitable diameter, height, thickness, coating or casing, and coating or casing thickness. For example, the c-seal 230 may be an alloy such as Inconel that is silver plated. However, in one particular embodiment, the c-seal 230 is used at the fourth stage 286 of the compressor 100 to withstand the operating conditions of the fourth cylinder 160. An o-ring may be subject to extrusion between the sealed surfaces, which may lead to a shorter service life.

At most operating conditions, the c-seal 230 prevents leaks between sealed surfaces. However, at some conditions, the temperatures and pressures of the fourth cylinder 160 may be higher than which the c-seal 230 is typically designed, particularly considering the high speeds and resulting flexing and relaxing that the c-seal 230 undergoes during each cycle. If unaddressed, the c-seal 230 may lose effectiveness over time. As such, a vent port 240 is provided in the sealing assembly 200 to cooperate with the c-seal 230 to address these issues by reducing the stress on the c-seal 230 and/or by accommodating any leaks that do occur. In one exemplary embodiment, the vent port 240 is perpendicular to the axis 110 of the cylinders 130, 140, 150, and 160, although other arrangements may be provided.

Generally, the vent port 240 is designed to reduce the stress on the c-seal 230. For example, at a predetermined pressure, air may leak across the c-seal 230 into the vent port 240. As a result, repeated deformation of the c-seal 230 by the air pressure changes of the fourth cylinder 160 is reduced. This relieves some of the pressure and stress on the c-seal 230 in certain situations. The vent port 240 also provides more control over leaks at the c-seal 230. In some instances, without a vent port, any air leaking across a c-seal may leak into undesired areas of the compressor. For example, the vent port 240 prevents leakage of air into the cooling passages.

The vent port 240 extends through the cylinder head 180 and is fluidly coupled to a vent tube 250 at the outer surface of the cylinder head 180. The vent tube 250 extends to the inlet 164 of the fourth stage 286. As such, the vent port 240 of the sealing assembly 200 is fluidly coupled to the inlet 164 of the fourth cylinder 160. The vent port 240 may be any suitable size, for example, the vent port 240 may be approximately 0.029 inches to approximately 0.036 inches, depending on the size of the compressor 100 and operating conditions. As a result, any air that leaks across the c-seal 230 is returned to the compressor 100 as working fluid. Conventional seal vents typically vent leaked air to an ambient pressure and out of the compressor.

As a result, the sealing assembly 200 provides seals between the compressor liner 120, housing 102, and cylinder head 180. The c-seal 230, vent port 240, and vent tube 250 enable sealing at high pressures, and even during leaks, return the air to the compressor 100, thereby increasing the efficiency of the compressor 100 and the service life of the c-seal 230.

Figure 3:
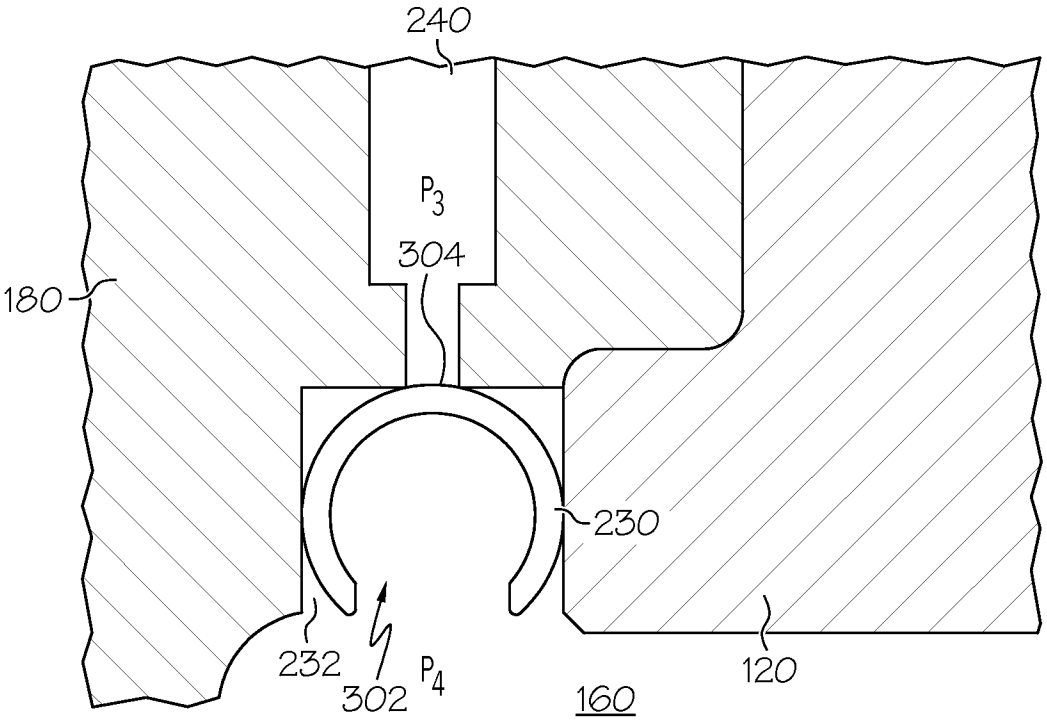
FIG. 3 is a more detailed cross-sectional view of a portion of the sealing assembly of FIG. 2 in accordance with an exemplary embodiment.

Additional details about the sealing assembly 200 are shown in FIG. 3, which is a more detailed cross-sectional view of a portion 300 of the sealing assembly 200 of FIG. 2 in accordance with an exemplary embodiment. FIGS. 1 and 2 are also referenced in the discussion below. In particular, FIG. 3 is a cross-sectional view of the c-seal 230 positioned in the recess 232 between the cylinder head 180 and compressor liner 120. The c-seal 230 has a first side (or interior/open side) 302 that faces the fourth cylinder 160 and a second side (or exterior/closed side) 304 that faces the vent port 240.

The pressure ($P_4$) on the first side 302 of the c-seal 230 is the pressure in the fourth cylinder 160, and the pressure ($P_V$) on the second side 304 corresponds to the pressure in the vent port 240. Since the vent port 240 is fluidly coupled to the inlet 164 of the fourth cylinder 160, the pressure ($P_V$) on the second side 304 of the c-seal 230 is the same as the pressure of the air after the third stage 284 of the compressor 100. As such, using the exemplary pressures listed above, the pressure ($P_V$) on the second side 304 of the c-seal 230 is typically about 1800 psig.

As noted above, when the fourth piston 162 is in a first or withdrawn position (e.g., as shown in FIGS. 1 and 2), the air in the fourth cylinder 160 is at the same pressure ($P_4$) as the air in the third cylinder 150. As such, in this condition, the pressure ($P_4$) on the first side 302 of the c-seal 230 is approximately equally to the pressure ($P_v$) on the second side 304 of the c-seal 230, thereby resulting in a pressure drop or differential ($\Delta P$) of zero. When the fourth piston 162 is in a second or pressurizing position (e.g., moved to the left of the position shown in FIGS. 1 and 2), the air in the fourth cylinder 160 is compressed to the final pressure of the fourth stage 286. Using the exemplary pressures discussed above, the pressure ($P_4$) on the first side 302 of the c-seal 230 rises to about 5000 psig. The pressure ($P_v$) on the second side 304 of the c-seal 230 is unchanged. As a result, the pressure drop or differential ($\Delta P$) between the pressure ($P_4$) on the first side 302 of the c-seal 230 and the pressure ($P_v$) on the second side 304 of the c-seal 230 in one exemplary embodiment is about 3200 psig.

Typically, the c-seal 230 is designed to withstand pressures of at least 3200 psig such that the c-seal 230 better accommodates the pressure changes over a long service life. In contrast, if the vent port extended to ambient, e.g., a pressure of zero, the pressure differential ($\Delta P$) would be about 5000 psig. Such a pressure differential ($\Delta P$) may cause undesirable issues for the c-seal, particularly when the compressor operates at speeds such as 5000 RPM or higher and at temperatures of about 400° F. or greater. However, the pressure differentials between the third and fourth stages resulting from the vent port 240 and vent tube 250 are suitable for the c-seal 230.

This arrangement provides a number of advantages. The vent port 240 and vent tube 250 to the inlet of the fourth stage 286 enables an improved service life for the c-seal 230. For example, the vent port 240 and vent tube 250 may prevent the c-seal 230 from being loaded in an opposite direction from which is it is designed. Moreover, due to the improved performance of the sealing assembly 200, the compressor 100 operates to recharge the ARS with a reduced number of cycles. Additionally, since the leaked air is returned to the third stage pressure, the efficiency of the compressor 100 is improved since, in effect, the work of the first three stages is not lost.

Accordingly, compressors with improved sealing assemblies are provided. Such a compressor may form part of an ARS with long lasting service life at high speeds (e.g., greater than 5000 RPM), high pressures (e.g., greater than 5,000 psig), and high temperatures (e.g., greater than 400° F.). The exemplary embodiments may be useful in the general context of any two or more seal surfaces, for example, in pressurized vessels to prevent the escape of pressure or in systems containing two or more separate mediums to prevent them from mixing together. In addition to the depicted embodiments, exemplary embodiments may also be well suited for use in high pressure hydraulic equipment; high performance pneumatic, vacuum and compressor systems; and high pressure systems in general where stationary, oscillatory, rotary or reciprocating surfaces may be sealed.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements. The word "exemplary" is used exclusively herein to mean "serving as an example, instance, or illustration." Any embodiment described herein as "exemplary" is not necessarily to be construed as preferred or advantageous over other embodiments.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A compressor, comprising:

a housing;

a compressor liner positioned within the housing and at least partially defining a first cylinder with an inlet and an outlet;

a piston positioned within the first cylinder and configured to compress air flowing into the first cylinder through the inlet;

a cylinder head at least partially defining the first cylinder; and a sealing assembly for sealing an interface between the compressor liner and the cylinder head, the sealing assembly comprising:

a ring seal at an interface between the cylinder head and the compressor liner;

a vent port on an opposite side of the ring seal from the first cylinder; and a vent tube extending between the vent port and the inlet such that air leaking through the ring seal from the first cylinder flows through the vent port, through the vent tube, and into the inlet.

2. The compressor of claim 1, wherein the vent port is defined in the cylinder head.

3. The compressor of claim 1, wherein the cylindrical liner defines a plurality of additional cylinders fluidly coupled together and to the first cylinder to compress the air in a plurality of stages, and wherein first cylinder forms a final stage of the plurality of stages.

4. The compressor of claim 3, wherein the additional cylinders form first, second, and third stages of compression, and wherein the first cylinder is a fourth stage of compression subsequent to the first, second, and third stages.

5. The compressor of claim 1, wherein first cylinder and the piston are configured to compress the air to recharge a bottle in an aircraft air recharge system.

6. The compressor of claim 1, wherein the ring seal is a c-seal.

7. The compressor of claim 6, wherein the c-seal includes an open side facing the first cylinder and a closed side facing the vent port.

8. The compressor of claim 7, wherein the c-seal is subject to a first pressure differential between the open side and the closed side when the piston is in a first position and a second pressure differential between the open side and the closed side when the piston is in a second position, wherein the first pressure differential is approximately zero and the second pressure differential is approximately 3200 psig.

9. The compressor of claim 1, wherein the sealing assembly is configured to operate in an environment with a pressure of at least 5000 psig.

10. The compressor of claim 1, wherein the housing, the compressor liner, and the cylinder head form a recess, the ring seal being positioned in the recess.

11. The compressor of claim 1, further comprising a plurality of o-rings positioned between the compressor liner and the housing.

12. The compressor of claim 1, wherein the compressor liner includes cooling passages configured to direct a cooling fluid through the compressor, and wherein the sealing assembly is configured to prevent the air from leaking into the cooling passages.

13. A sealing assembly between a first component and a second component of a compressor with a cylinder having an inlet and an outlet, comprising:

a ring seal between the first component and the second component at the outlet of the compressor;

a vent port defined by the first component and at least partially sealed by the ring seal from air compressed within the cylinder; and a vent tube extending between the vent port and the inlet such that any portion of the air that leaks through the ring seal flows through the vent port, through the vent tube, and into the inlet.

14. The sealing assembly of claim 13, wherein the vent port is defined in the first component.

15. The sealing assembly of claim 13, wherein the ring seal is a c-seal.

16. The sealing assembly of claim 15, wherein the c-seal includes an open side facing the first cylinder and a closed side facing the vent port.

17. The sealing assembly of claim 16, wherein the compressor has a piston positioned in the cylinder, and wherein the c-seal is subject to a first pressure differential between the open side and the closed side when the piston is in a first position and a second pressure differential between the open side and the closed side when the piston is in the second position, wherein the first pressure differential is approximately zero and the second pressure differential is approximately 3200 psig.

18. The sealing assembly of claim 13, wherein the c-seal is configured to operate in an environment with pressure at least 5000 psig.

19. The sealing assembly of claim 13, further comprising a plurality of o-rings positioned between the compressor liner and the housing.

20. A compressor, comprising:

a housing;

a compressor liner positioned within the housing and at least partially defining first, second, third and fourth cylinders, each of the cylinders having an inlet and an outlet, and the cylinders respectively corresponding to first, second, third, and fourth stages of compression;

a cylinder head at least partially defining the fourth cylinder; and a sealing assembly for sealing an interface between the compressor liner, the cylinder head, and the housing, the sealing assembly comprising:

a c-seal at an interface between the cylinder head and the compressor liner;

a vent port on an opposite side of the c-seal from the fourth cylinder; and a vent tube extending between the vent port and the inlet such that air leaking through the c-seal from the fourth cylinder flows through the vent port, through the vent tube, and into the inlet of the fourth cylinder.

* * * * *